US007824220B2

(12) United States Patent
Chen

(10) Patent No.: US 7,824,220 B2
(45) Date of Patent: Nov. 2, 2010

(54) ELECTRICAL CONNECTOR

(75) Inventor: Wan-Tien Chen, Taipei (TW)

(73) Assignee: WonTen Technology Co., Ltd., Taipei (TW)

( * ) Notice: Subject to any disclaimer, the term of this patent is extended or adjusted under 35 U.S.C. 154(b) by 171 days.

(21) Appl. No.: 12/010,096

(22) Filed: Jan. 18, 2008

(65) Prior Publication Data

US 2009/0186528 A1 Jul. 23, 2009

(30) Foreign Application Priority Data

Nov. 16, 2007 (TW) ..... 96219371 U

(51) Int. Cl.
*H01R 13/648* (2006.01)

(52) U.S. Cl. ..... 439/607.35; 439/660

(58) Field of Classification Search . 439/607.35–607.4, 439/607.54–607.56

See application file for complete search history.

(56) References Cited

U.S. PATENT DOCUMENTS 5,928,035 A * 7/1999 Jankowsky et al. ..... 439/607.36
6,193,552 B1 * 2/2001 Chiou et al. ..... 439/607.35
6,383,023 B1 * 5/2002 Chang et al. ..... 439/607.35
7,108,552 B2 * 9/2006 Niitsu et al. ..... 439/607.35
2005/0186843 A1 * 8/2005 Tsai ..... 439/607
2007/0054553 A1 * 3/2007 Nishio et al. ..... 439/607

* cited by examiner

*Primary Examiner*—Hien Vu
(74) *Attorney, Agent, or Firm*—Guice Patents PLLC

(57) ABSTRACT

The present invention discloses an electrical connector, including a housing, a base body with its front end extending to form a tongue, whose one surface is disposed with a plurality of first terminal slots and whose other surface is disposed with a plurality of second terminal slots, with the first and second terminal slots being alternately arranged in a top/down fashion; a first terminal assembly; and a second terminal assembly; such that when the above components are assembled, a display port plug or a High-Definition Multimedia Interface (HDMI) plug can be plugged therein and all or some of the terminals of the first and second terminal assemblies are used to achieve electrical connection.

12 Claims, 7 Drawing Sheets

ELECTRICAL CONNECTOR

FIELD OF THE INVENTION

The present invention relates to an electrical connector, and more particular to an electrical connector which can be plugged in for a display port plug or a High-Definition Multimedia Interface (HDMI) plug.

BACKGROUND OF THE INVENTION

With the incessant development in technology, the definition of display devices (liquid crystal displayer (LCD) or liquid crystal display TV, for example) has been increased steadily. A LCD TV in the market is usually provided with a High-Definition Multimedia Interface (HDMI) plug or display port interface to be connected with a computer or other video device. The HDMI interface supporting a definition up to 1600×1200 is using the HDMI electrical connector, which has 19 pins. On the other hand, the display port interface is the next generation of interface for such an application, supporting a definition up to 2560×1600, which employs a display port electrical connector having 20 pins.

It is conceivable that, as a result of generation shift, a LCD TV will have both a HDMI interface and a display port interface for consumers. However, the current electrical connectors for HDMI or display port have different numbers of pin and thus cannot be shared between them. It is therefore necessary to design a new electrical connector to overcome the aforementioned drawback.

SUMMARY OF THE INVENTION

In view of the foregoing shortcomings of the prior art, the inventor of the present invention based on years of experience in the related industry to conduct extensive researches and experiments, and finally invented an electrical connector in accordance with the present invention.

The objective of the present invention is to provide an electrical connector, which can be plugged in for a display port plug or a High-Definition Multimedia Interface (HDMI) plug.

To achieve the aforementioned object, an electrical connector according to the present invention comprises: a housing disposed with a receiving chamber; a base body received in the receiving chamber with its front end extending to form a tongue, whose one surface is disposed with a plurality of first terminal slots and whose other surface is disposed with a plurality of second terminal slots, with the first and second terminal slots being alternately arranged in a top/down fashion; a first terminal assembly disposed with a plurality of first terminals, which have a contact portion and a pin, respectively, with the contact portions disposed in the first terminal slots and the pins protruding out of the housing; and a second terminal assembly disposed with a plurality of second terminals, which have a contact portion and a pin, respectively, with the contact portions disposed in the second terminal slots and the pins protruding out of the housing; such that when the above components are assembled, a first plug or a second plug can be plugged therein and all or some of the terminals of the first and second terminal assemblies are used to achieve electrical connection.

To make it easier for our examiner to understand the objective of the invention, its structure, innovative features, and performance, we use a preferred embodiment together with the attached drawings for the detailed description of the invention.

DETAILED DESCRIPTION OF THE PREFERRED EMBODIMENTS

The structure, technical measures and effects of the present invention will now be described in more detail hereinafter with reference to the accompanying drawings that show various embodiments of the invention.

Figure 1A:
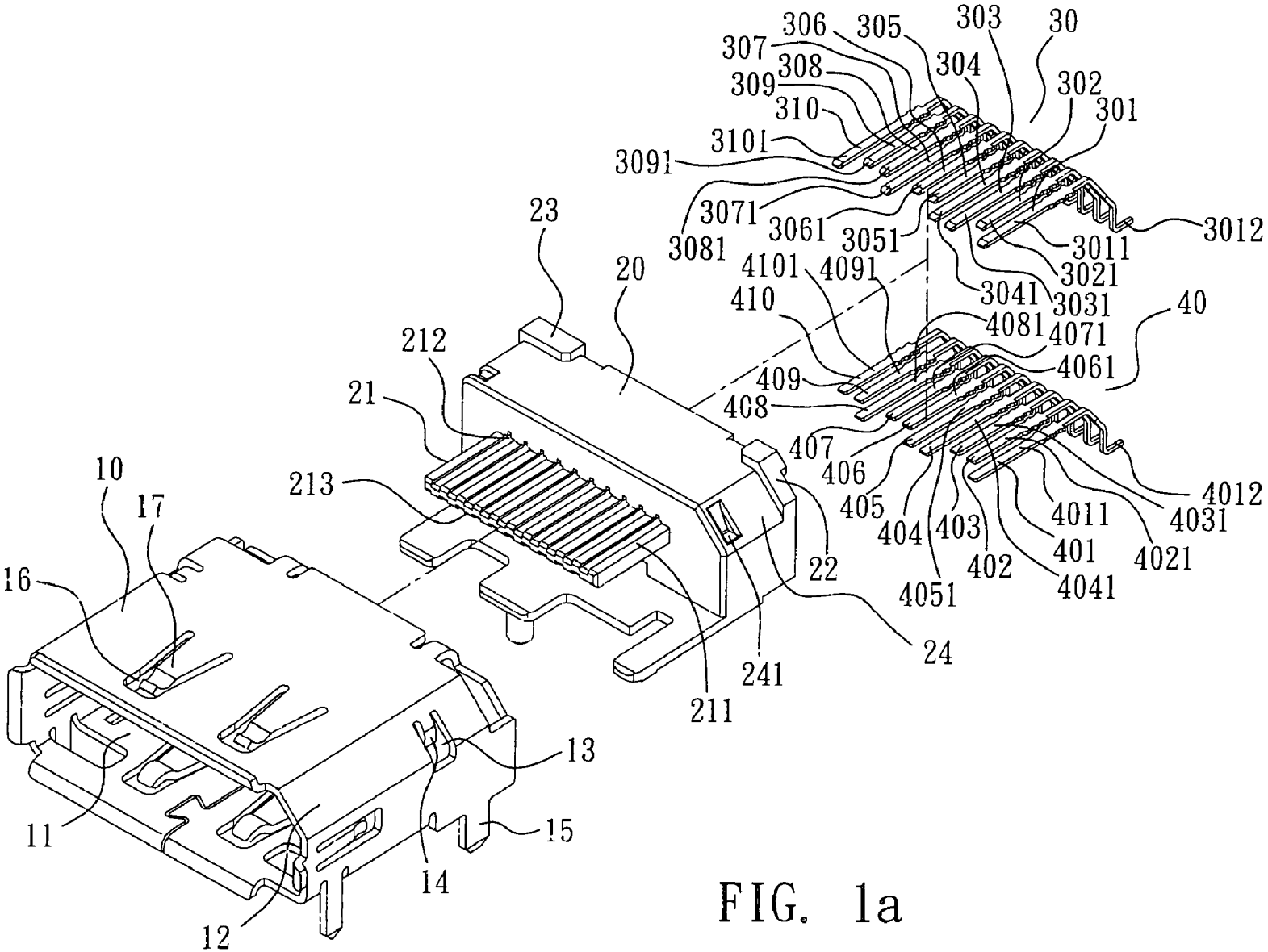
FIG. 1*a* is the front exploded perspective view of an electrical connector in accordance with one preferred embodiment of the present invention.
Figure 1B:
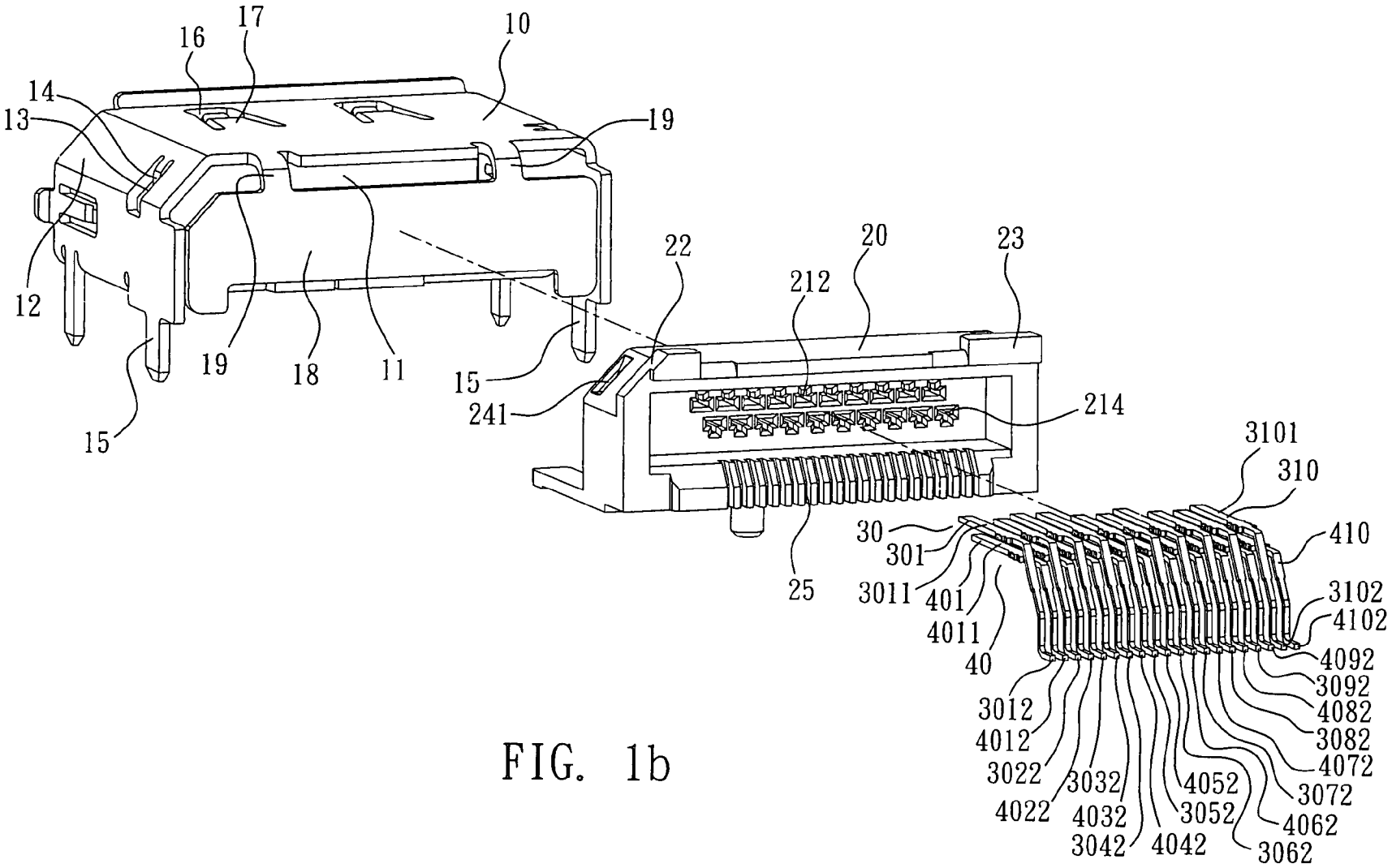
FIG. 1*b* is the rear exploded perspective view of an electrical connector in accordance with one preferred embodiment of the present invention.
Figure 2:
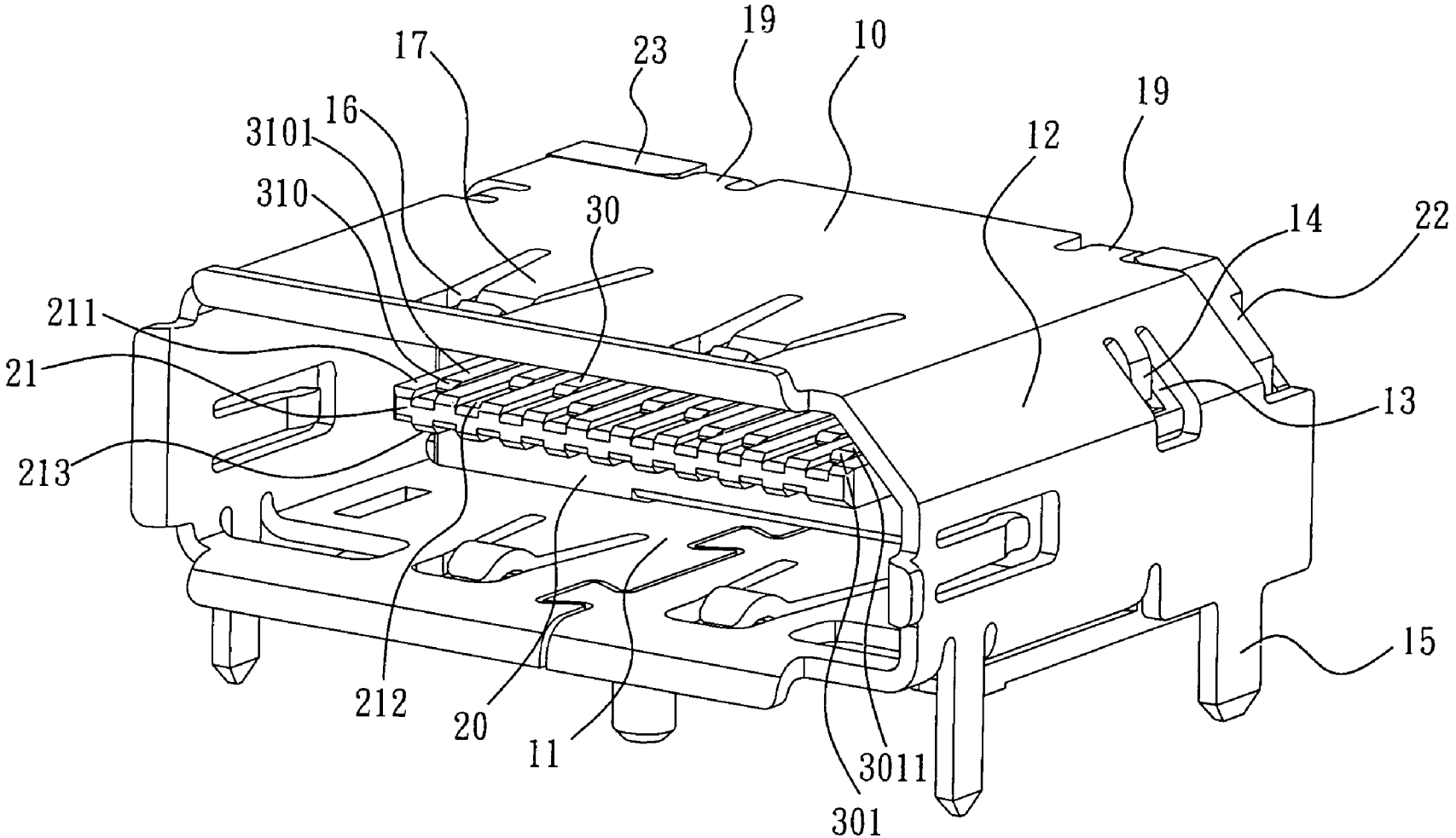
FIG. 2 is an assembled perspective view of an electrical connector in accordance with the present invention.
Figure 3A:
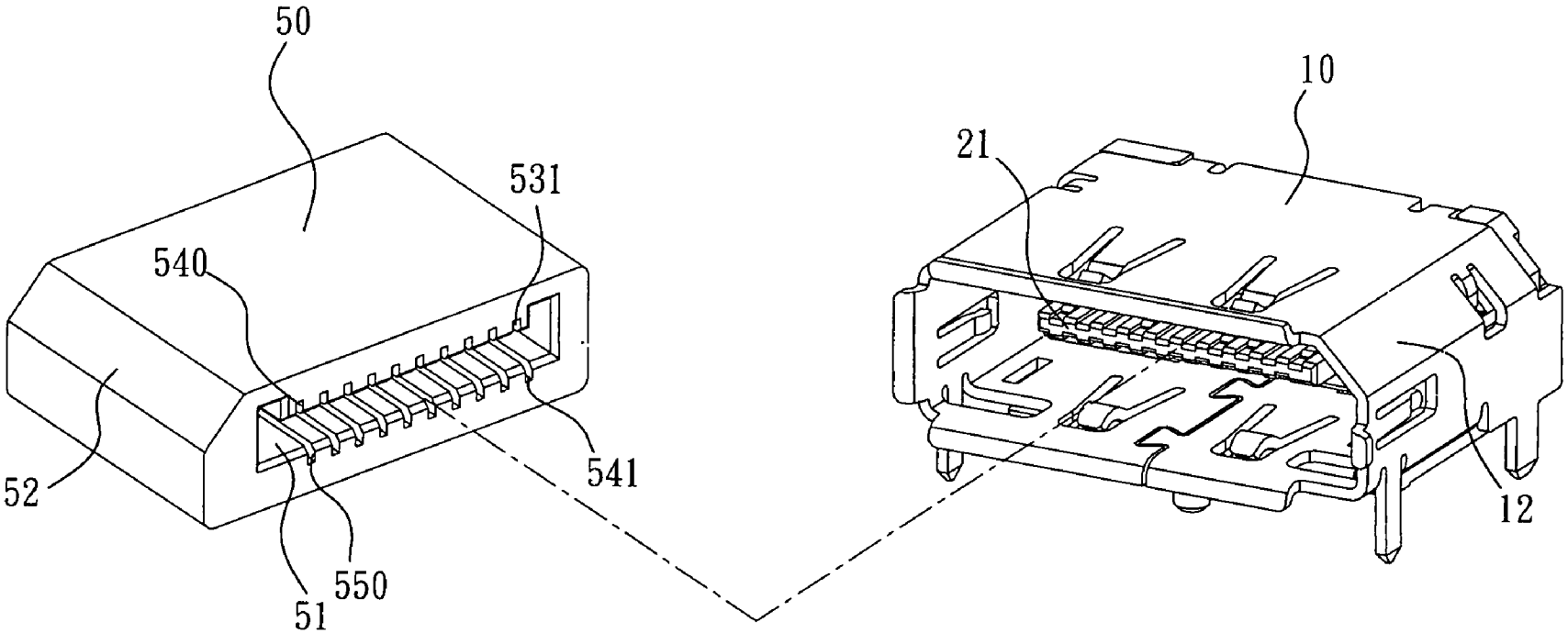
FIG. 3*a* is a perspective view of an electrical connector in accordance with the present invention being connected with a HDMI plug.
Figure 3B:
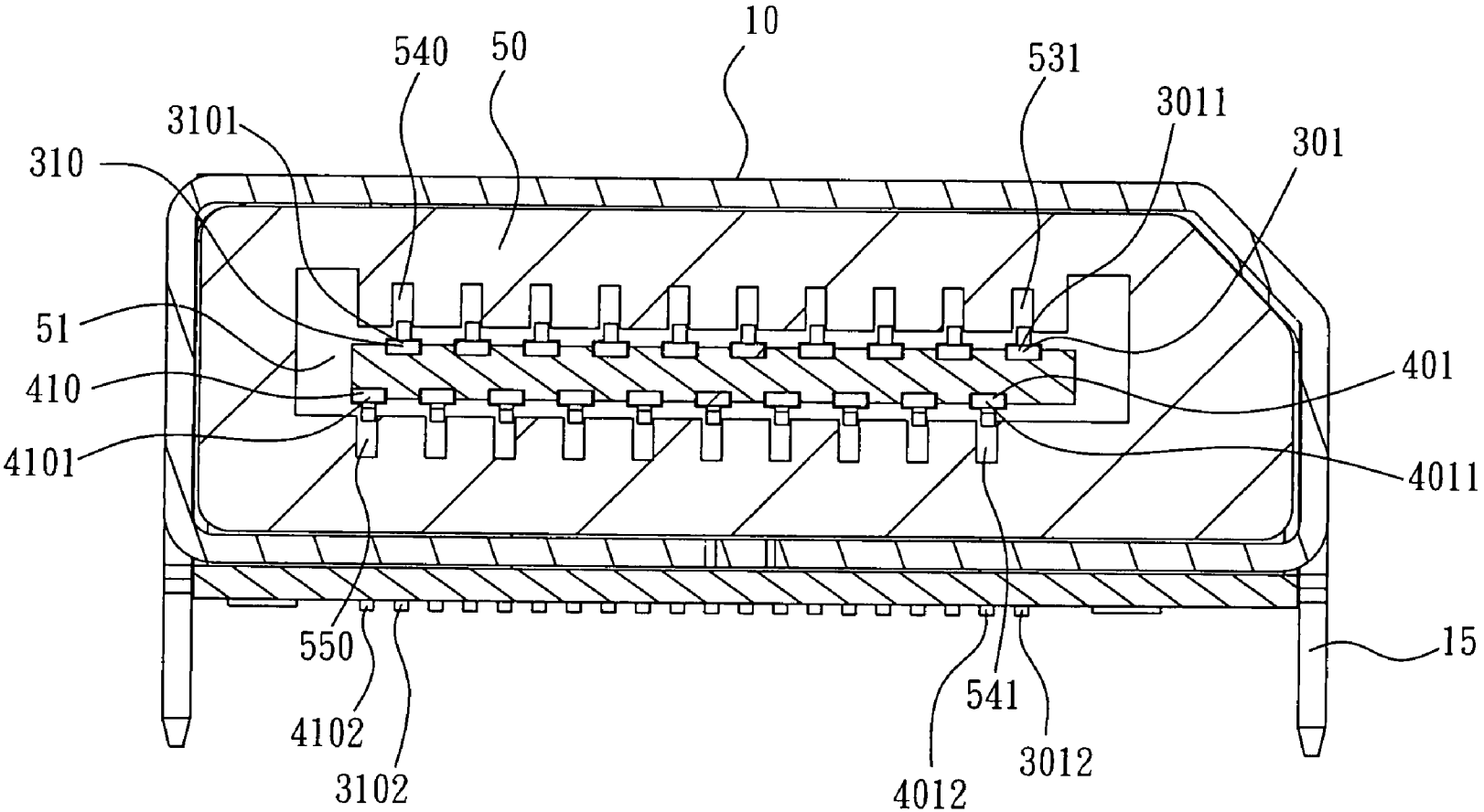
FIG. 3*b* is cross-sectional view of the terminals connection for an electrical connector in accordance with the present invention connected with a HDMI plug.
Figure 4A:
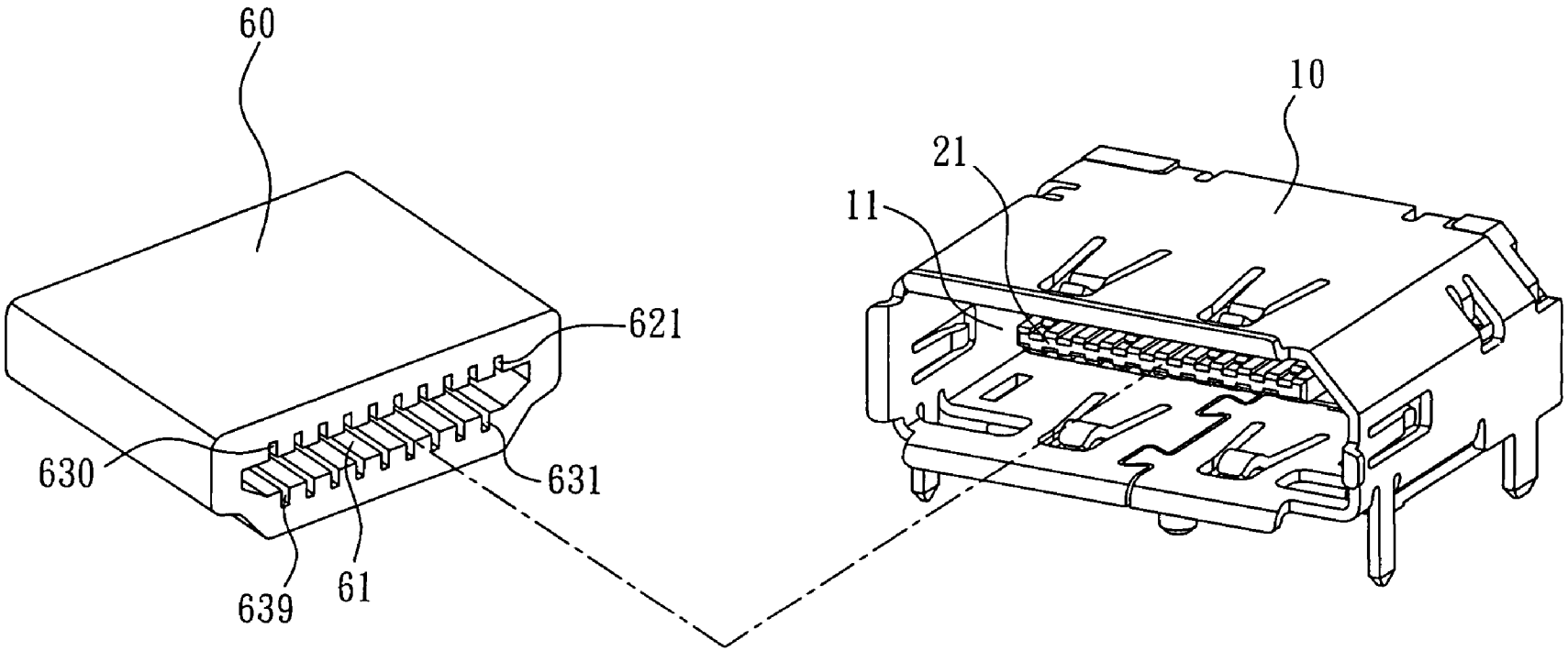
FIG. 4*a* is a perspective view of an electrical connector in accordance with the present invention being connected with a display port plug.
Figure 4B:
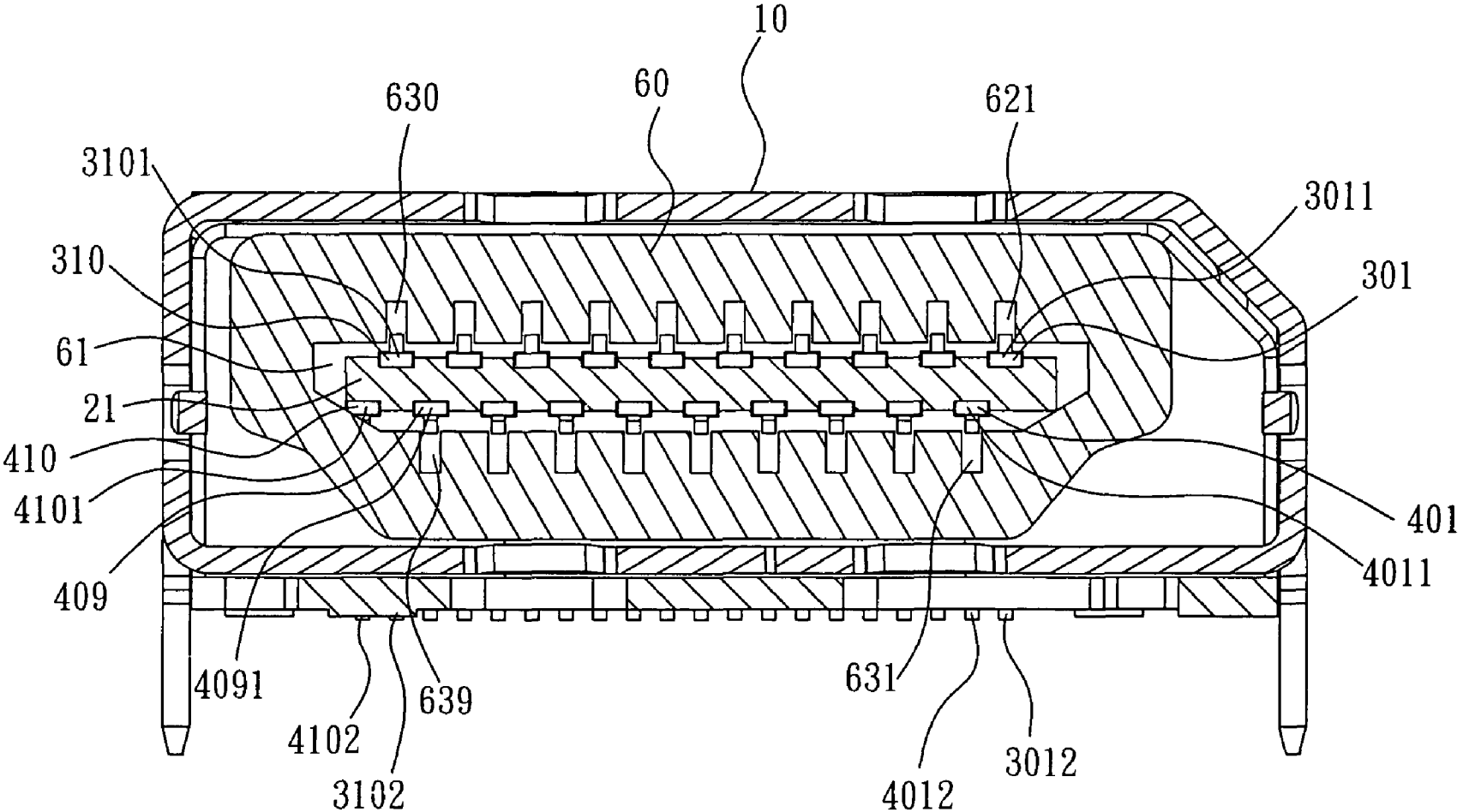
FIG. 4*b* is cross-sectional view of the terminals connection for an electrical connector in accordance with the present invention connected with a display port plug.

Refer to the figures for the further disclosure of the technical contents of the present invention, wherein FIG. 1*a* is the front exploded perspective view of an electrical connector in accordance with one preferred embodiment of the present invention; FIG. 1*b* is the rear exploded perspective view of an electrical connector in accordance with one preferred embodiment of the present invention; FIG. 2 is an assembled perspective view of an electrical connector in accordance with the present invention. FIG. 3*a* is a perspective view of an electrical connector in accordance with the present invention being connected with a HDMI plug; FIG. 3*b* is cross-sectional view of the terminals connection for an electrical connector in accordance with the present invention connected with a HDMI plug; FIG. 4*a* is a perspective view of an electrical connector in accordance with the present invention being connected with a display port plug; and FIG. 4*b* is cross-sectional view of the terminals connection for an electrical connector in accordance with the present invention connected with a display port plug.

With reference to the aforementioned figures, an electrical connector in accordance with the present invention comprises a housing 10, a base body 20, a first terminal assembly 30, and a second terminal assembly 40, wherein the housing 10 is disposed with a receiving chamber 11. The housing 10 is made of, for example but not limited to, metal, which is a conventional art and will not be described here furthermore. The right side of the housing 10 is formed to have a slant face 12 which is disposed with a first opening 13, from which a retaining portion 14 bended inward is further disposed. Also, the bottom of the two sidewalls of the housing 10 is further disposed with at least a welding piece 15 on each side, which may be further securingly fixed onto a printed circuit board (not shown) to enhance the retaining strength.

Furthermore, the upper and lower walls of the housing 10 are formed to have a second opening 16, respectively, from which a ground finger 17 bended inward is formed by. Also, the rear side of the housing 10 is disposed with a mask 18, which is connected onto the housing 10 by two connection arms 19. Also, the mask 18 and the bottom of the housing 10 has a long and narrow spacing therebetween for the assembling of the base body 20.

The base body 20 is received in the receiving chamber 11 and it is preferably made of insulating material and its front end is extended to form a tongue 21, whose one surface 211 is disposed with a plurality of first terminal slots 212 and other surface 213 is disposed with a plurality of second terminal slots 214. The first terminal slots 212 and the second terminal slots 214 are alternately arranged in a top/bottom fashion; wherein the first terminal slots 212 are, for example but not limited to be, formed on the upper surface 211 of the tongue 21, and are, for example but not limited to be, in a upward protruding shape; and the second terminal slots 214 are, for example but not limited to be, formed on the lower surface 213 of the tongue 21, and are, for example but not limited to be, in a downward protruding shape. Furthermore, the two rear ends of the base body 20 are disposed with engagement blocks 22 and 23, respectively. A plurality of pin slots 25 are disposed at the rear side of the base body 20 below the second terminal slots 214, and the number of the pin slots 25 equal to the total of the plurality of the terminals of the first terminal assembly 30 and second terminal assembly 40 to receive them therein. Additionally, the base body 20 is also formed to have a slant face 24 which is further disposed a retaining slot 241 to receive the retaining portion 14.

The first terminal assembly 30 has a plurality of first terminals 301 to 310, ten in total, disposed on the upper surface of the tongue 21. The first terminals 301 to 310 are respectively disposed with a contact portion 3011 to 3101 and a pin 3012 to 3102. The contact portions 3011 to 3101 are respectively received in the first terminal slot 212, and the pins 3012 to 3102 may protrude out of the housing 10. Also, the ends of the pins 3012 to 3102 are bended horizontally and are paralleled with respect to one another.

The second terminal assembly 40 has a plurality of second terminals 401 to 410, ten in total, disposed on the lower surface of the tongue 21. The second terminals 401 to 410 are respectively disposed with a contact portion 4011 to 4101 and a pin 4012 to 4102. The contact portions 4011 to 4101 are respectively received in the second terminal slots 214, and the pins 4012 to 4102 may protrude out of the housing 10. Also, the ends of the pins 4012 to 4102 are bended horizontally and are paralleled with respect to one another.

With reference to FIG. 2, when the base body 20 and the first terminal assembly 30 as well as the second terminal assembly 40 are being assembled, the contact portions 3011 to 3101 of the first terminals 301 to 310 are respectively inserted into the first terminal slots 212 from the rear side of the base body 20, and their pins 3012 to 3102 extend downward and are securingly fixed onto the pin slots 25 at the rear side of the base body 20. Then, the contact portions 4011 to 4101 of the second terminals 401 to 410 are respectively inserted into the second terminal slots 214 from the rear side of the base body 20, and their pins 4012 to 4102 extend downward and are securingly fixed onto the pin slots 25 at the rear side of the base body 20. Also, the pins 3012 to 3102 and 4012 to 4102 are arranged in are paralleled with respect to one another. The base body 20, after being assembled, is positioned onto receiving chamber 11 through the long and narrow spacing at the bottom of the housing 10 and the engagement blocks 22 and 23 protruding outward are engaged into the sidewall of the connection arm 19 and the housing 10, respectively.

With reference to FIG. 3*a,* an electrical connector in accordance with the present invention being assembled can be plugged in for a first plug 50, for example but not limited to a display port plug, wherein the first plug 50 has a accommodating space 51, a fool-proof inclined face 52, and twenty contact portions 531 to 550, of which ten contact portions 531 to 540 are disposed at the upper of the accommodating space 51 and ten contact portions 541 to 550 are disposed at the lower of the accommodating space 51. When the first plug 50 is inserted into the electrical connector in accordance with the present invention, the fool-proof inclined face 52 at the top right corner of the first plug 50 is positioned, through the slant face 12 of the housing 10, into the receiving chamber 11, and the "recessed" accommodating space 51 is contacted with and receive the tongue 21. When the insertion is being made, with reference to FIG. 3*b,* the ten contact portions 531 to 540 at the upper of the accommodating space 51 in the first plug 50 are electrically connected with the contact portions 3011 to 3101 of the first terminals 301 to 310, respectively. Also, the ten contact portions 541 to 550 at the lower of the accommodating space 51 in the first plug 50 are electrically connected with the contact portions 4011 to 4101 of the second terminals 401 to 410, respectively, so as to complete the connection. The twenty contact portions 531 to 550 of the display port plug are convention art and will be discussed here furthermore.

With reference to FIG. 4*a,* an electrical connector in accordance with the present invention being assembled can be plugged in for a second plug 60, for example but not limited to a HDMI plug, wherein the second plug 60 has an accommodating space 61 and nineteen contact portions 621 to 639, of which ten contact portions 621 to 630 are disposed at the upper of the accommodating space 61 and nine contact portions 631 to 639 are disposed at the lower of the accommodating space 61. When the second plug 60 is inserted into the electrical connector in accordance with the present invention, the plug 60 has to be inversed first and then be positioned into the receiving chamber 11, such that the accommodating space 61 is contacted with and receive the tongue 21. When the insertion is being made, with reference to FIG. 4*b,* the ten contact portions 621 to 630 at the upper of the accommodating space 61 are electrically connected with the contact portions 3011 to 3101 of the first terminals 301 to 310, respectively. Also, the nine contact portions 631 to 639 at the lower of the accommodating space 61 in the second plug 60 are electrically connected with the contact portions 4011 to 4091 of the second terminals 401 to 409, respectively; and the contact portion 4101 of the second terminal 410 is at an idle state. Consequently, the connection is completed. The nineteen contact portions 621 to 639 of the HDMI plug are convention art and will be discussed here furthermore.

After being assembled, an electrical connector in accordance with the present invention can be plugged in for a HDMI plug or display plug; thus, the ease of use can be enhanced as well as the space and cost can be greatly cut down since there is no need to install two connectors, a HDMI electrical connector and a display port connector, in a display device. Consequently, an electrical connector in accordance with the present invention is indeed an advanced design in comparison with the conventional art.

Consequently, an electrical connector in accordance with the present invention can be plugged in for a HDMI plug or display plug such that the cost can be greatly cut down, and thus the present invention is indeed an advanced design in comparison with the conventional art.

The present invention provides a feasible solution, and a patent application is duly filed accordingly. However, it is to be noted that the preferred embodiments disclosed in the specification and the accompanying drawings are not intended to limit the invention. To the contrary, it is intended to cover various modifications and similar arrangements and procedures, and thus the scope of the appended claims should be accorded the broadest interpretation so as to encompass all such modifications and similar arrangements and procedures.

What is claimed is:

1. An electrical connector comprising:

a housing having a receiving chamber;

a insulated base body located in the receiving chamber and having a tongue extending from a front end thereof, the tongue having a first surface having a plurality of first terminal slots and a second surface having a plurality of second terminal slots, the plurality of first terminal slots and the plurality of second terminal slots are alternately arranged from top to bottom across the first surface and second surface of the tongue, the base body has two engagement blocks protruding upwardly from and being spaced apart on opposing sides of a rear end of the base body;

a first short and long terminal assembly having a plurality of first terminals, each of the plurality of first terminals has a contact portion and a pin, each contact portion of the plurality of first terminals is inserted into a corresponding one of the plurality of first terminal slots and each corresponding pin protruding outwardly from the housing; and a second short and long terminal assembly having a plurality of second terminals, each of the plurality of second terminals has a contact portion and a pin, each contact portion of the plurality of second terminals is inserted into a corresponding one of the plurality of second terminal slots and each corresponding pin protruding outwardly from the housing;

wherein, when the housing, the base body, the first terminal assembly, and the second terminal assembly are assembled forming an electrical connector assembly, a plug is connected to the electrical connector assembly, the plug having a receiving space with upper contact portions and lower contact portions electrically connected to corresponding terminals of the plurality of first terminals and the plurality of second terminals;

wherein the housing is made of metal and has a housing slant face located on a right side thereof, a first opening located in the slant face, and a retaining portion extending inwardly into the first opening and being bent;

wherein the base body has a base body slant face located on a right side thereof and two retaining slots spaced apart and located on opposing sides of a front end of the base body slant face, the retaining portion of the housing being inserted into the retaining slot of the base body;

wherein the housing has a mask located on a rear side thereof, the mask is connected to the housing by two connection arms, the housing has a long and narrow space located between the mask and a bottom of the housing for the assembling the base body, and the engagement blocks are protruding outwardly and engaging sidewalls of the connection arms and the housing, respectively;

wherein the base body is connected to the housing by the retaining portion of the housing being inserted into the retaining slot of the base body and the engagement blocks engaging sidewalls of the connection arms and the housing;

wherein the plug is a high definition multimedia interface (HDMI) plug.

2. The electrical connector according to claim 1, wherein the housing has two side walls, each of the two side walls has a welding piece located on a bottom thereof for connecting the electrical connector to a printed circuit board.

3. The electrical connector according to claim 1, wherein the plurality of first terminals are ten first terminals located on an upper surface of the tongue, and the plurality of second terminals are ten second terminals located on a lower surface of the tongue.

4. The electrical connector according to claim 3, wherein the plurality of contact portions of the plug are twenty contact portions, the ten first terminals and the ten second terminals are electrically connected with the twenty contact portions of the plug, respectively.

5. The electrical connector according to claim 4, wherein the plug is a display port plug.

6. The electrical connector according to claim 3, wherein the plurality of contact portions of the plug are nineteen contact portions, nineteen terminals of the ten first terminals and the ten second terminals are electrically connected with the nineteen contact portions of the plug, respectively.

7. The electrical connector according to claim 6, wherein the plug is a display port plug.

8. The electrical connector according to claim 3, wherein the plurality of contact portions of the plug are nineteen contact portions, ten terminals of the ten first terminals and nine terminals of the ten second terminals are electrically connected with the nineteen contact portions of the plug, respectively.

9. The electrical connector according to claim 1, wherein upper and lower walls of the housing have second openings, each of the second openings has a ground finger bent inwardly.

10. The electrical connector according to claim 1, wherein the first terminal slots have an upward protruding shape and the second terminal slots have a downward protruding shape.

11. The electrical connector according to claim 1, further comprising a plurality of pin slots located on a rear side of the base body below the second terminal slots, and the plurality of pin slots is equal to a total number of the plurality of first terminals and the plurality of second terminals and the plurality of first terminals and the plurality of second terminals are received therein.

12. The electrical connector according to claim 1, wherein ends of the pins of the plurality of first terminals and the plurality of second terminals are bent horizontally and extend parallel relative to one another.

* * * * *